US005983870A

United States Patent [19]

Bohl et al.

[11] Patent Number: 5,983,870

[45] Date of Patent: Nov. 16, 1999

[54] ADSORPTION FILTER FOR THE FUEL TANK VENTING SYSTEM OF AN INTERNAL COMBUSTION ENGINE AND PROCESS FOR OPERATING SAID SYSTEM

[75] Inventors: Matthias Bohl, Weinstadt; Harald Haufe, Stuttgart; Klaus Schweikert, Obersulm; Kay Brodesser, Rutesheim; Uwe Mohr, Stuttgart, all of Germany

[73] Assignee: Knecht Filterwerke GmbH, Stuttgart, Germany

[21] Appl. No.: 09/180,068

[22] PCT Filed: Jun. 6, 1997

[86] PCT No.: PCT/DE97/01137

§ 371 Date: Oct. 30, 1998

§ 102(e) Date: Oct. 30, 1998

[87] PCT Pub. No.: WO97/47874

PCT Pub. Date: Dec. 18, 1997

[30] Foreign Application Priority Data

Jun. 14, 1996 [DE] Germany ..... 196 23 740
Jul. 12, 1996 [DE] Germany ..... 196 28 153

[51] Int. Cl.[6] ..... F02M 37/04

[52] U.S. Cl. ..... 123/520; 123/198 D

[58] Field of Search ..... 123/520, 519, 123/518, 516, 521, 198 D; 55/383, 385.3, 385.4

[56] References Cited

U.S. PATENT DOCUMENTS

| | | | |
|---|---|---|---|
| 5,408,976 | 4/1995 | Reddy . | |
| 5,456,237 | 10/1995 | Yamazaki | 123/520 |
| 5,460,141 | 10/1995 | Denz | 123/520 |
| 5,483,942 | 1/1996 | Perry | 123/520 |
| 5,487,369 | 1/1996 | Hara et al. . | |
| 5,499,614 | 3/1996 | Busato | 123/520 |
| 5,553,577 | 9/1996 | Denz | 123/520 |
| 5,791,321 | 8/1998 | Kondoh | 123/520 |
| 5,794,599 | 8/1998 | Blumenstock | 123/520 |
| 5,816,222 | 10/1998 | Kipokoro | 123/520 |
| 5,829,416 | 11/1998 | Teraoka | 123/520 |
| 5,857,446 | 1/1999 | Norton | 123/520 |
| 5,890,474 | 4/1999 | Schnaibel | 123/520 |

FOREIGN PATENT DOCUMENTS

| | | |
|---|---|---|
| 0 681 101 | 11/1995 | European Pat. Off. . |
| 26 01 044 | 7/1976 | Germany . |
| 25 47 065 | 9/1977 | Germany . |
| 41 24 465 | 1/1993 | Germany . |
| 55-010081 | 11/1980 | Japan . |
| 5-312113 | 11/1993 | Japan . |
| 6-147033 | 5/1994 | Japan . |
| WO 94/18447 | 8/1994 | WIPO . |

*Primary Examiner*—Carl S. Miller
*Attorney, Agent, or Firm*—Collard & Roe, P.C.

[57] ABSTRACT

A process and device are provided to supply the air mass flux required to regenerate the adsorption material of an adsorption filter in the fuel tank venting system of an internal combustion engine while the engine is running and independently of a depression in the air intake pipe of the engine. For this purpose, atmospheric air is fed at least partially and temporarily by an air pump through the adsorption filter to the air intake pipe of the internal combustion engine while the engine is running. The air pump integrated in the device makes it possible to obtain a module which is easy to produce and to handle and which contains all units of the venting system.

6 Claims, 1 Drawing Sheet

Figure 1:
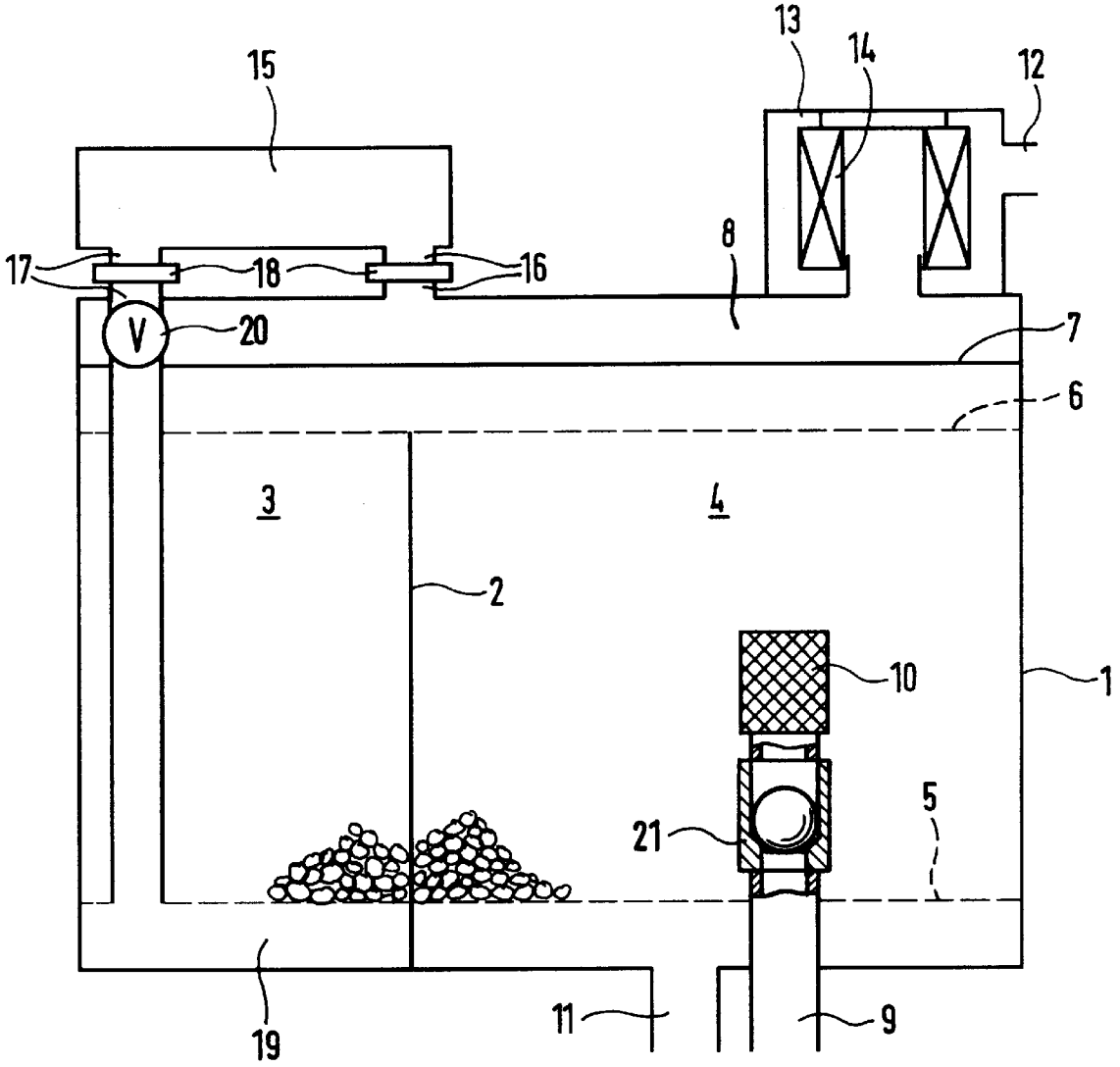

ADSORPTION FILTER FOR THE FUEL TANK VENTING SYSTEM OF AN INTERNAL COMBUSTION ENGINE AND PROCESS FOR OPERATING SAID SYSTEM

The invention relates to an adsorption filter for a fuel tank venting system of an internal combustion engine according to the pre-characterizing clause of patent claim 1 and to a method for operating this system.

The filter as such is known, for example, from DE 41 24 465 A1.

Proceeding from this, the invention is concerned, in respect of the design of such a filter, with the problem of designing the individual assemblies of the fuel tank venting system as a compact modular part which is economical to manufacture and can be fitted in a simple way to the tank and the intake-air line of the internal combustion engine.

This part of the object is achieved by designing the absorption filter according to the characterizing features of patent claim 1.

The subclaims indicate advantageous embodiments of this design.

The problem with which the invention is concerned also involves ensuring a reliable regeneration of the absorption material even in engines in which, for whatever reasons, an insufficient vacuum prevails in the intake-air line while the engine is operating.

This problem relating to the operation of the device according to the invention is solved by means of a method having the characterizing features of patent claim 1.

Although it is already known from DE 26 01 044 A1 and DE 25 47 065 A1 to regenerate an adsorption filter by means of air from a compressed-air source, those devices and methods nevertheless refer to special instances which cannot be compared with the operation of a system to which the present invention relates.

The further claims relate to expedient embodiments.

The teaching of claim 6 ensures that the engine combustion process is not adversely influenced by air which is pumped into the intake line of the internal combustion engine and led through the adsorption filter.

An exemplary embodiment of the invention is illustrated diagrammatically in the single FIG. 1 of the drawing.

In an adsorption filter housing 1, a larger and a smaller chamber for receiving activated charcoal as a medium for the adsorption of fuel vapors from an internal combustion engine tank, not illustrated, are formed by means of a partition 2. The smaller chamber is designated by 3 and the larger chamber by 4. The two chambers 3 and 4 are vertically closed at the top and bottom by means of permeable covers 5 and 6, a clearance relative to an adjacent wall of the filter housing 1 being provided, in each case to form a flow duct, on the sides of the covers 5 and 6 which face away from the covered activated charcoal. This flow space is separated vertically at the bottom, between the smaller and larger chambers 3 and 4, by means of the intermediate wall 2.

The flow duct located vertically above the upper cover 6 is formed by an intermediate wall 7 of the filter housing 1. An additional separate flow duct 8 is also formed by the intermediate wall 7 together with a region of the outer wall of the filter housing 1.

A connection piece 9 leading into the larger chamber 4 is provided for connecting a tank venting line. A sieve basket 10 is slipped over the mouth of this connection piece 9, the said mouth leading into the activated charcoal. The larger chamber 4 can be connected, via a further connection piece 11, to a region of the intake-air line of the internal combustion engine, the said region being under a vacuum when the engine is in operation. The last-mentioned connection can be broken by means of a valve.

A connection piece 12 leading to the atmosphere is located on an air-filter housing 13 connected to the adsorption filter housing 1. Seated in the air-filter housing 13 is an annular air filter 14, of which the radially outer region is connected to the line 12 for connection to the atmosphere and the radially inner region is connected to the flow duct 8.

A housing having a compressed-air source 15 is attached directly to the filter housing 1, this compressed-air source being, in particular, an air pump. The housing of the compressed-air source 15 is attached via junction lines 16 and 17 leading into the interior of the filter housing 1. Inserted in each case in these junction lines are elements 18 which uncouple the housing of the compressed-air source 15 from the filter housing 1 in terms of vibration. The junction line 17 leads out from the delivery side of the compressed-air source 15 into a flow space 19 which adjoins that end of the smaller chamber 3 which is remote from the larger chamber 4 in terms of flow. Provided in the junction line 17 is a closing valve 20 which may be arranged, in particular, at the transition of the housing of the compressed-air source 15 into this line. The compressed-air source 15 is connected to the flow duct 8 on the suction side via the junction line 16.

The venting system described functions as follows.

Loading with Fuel Vapors from the Fuel Tank

Fuel vapor flowing out of a tank, not illustrated, passes, via the connecting line 9, into the larger chamber 4 of the adsorption filter housing 1, the said chamber being filled with activated charcoal. The fuel vapor, pretreated in the chamber 4, leaves the latter in the direction of the smaller chamber 3 which is likewise filled with activated charcoal and through which the said vapor flows into the flow space 19. The tank venting stream, freed of fuel, passes from there, via the supply and discharge lines 17 and 16, into the compressed-air source 15, in order to pass through the flow space 8 and, via the air filter 14, through the connection piece 12 into the atmosphere. The compressed-air source 15 is designed to be permeable to the flow of the tank venting stream travelling in this direction.

Regeneration of the Adsorption Medium of the Adsorption Filter

To regenerate the adsorption filter, the flow passes through the latter in the opposite direction while the internal combustion engine is running, atmospheric air being sucked in through the connection piece 12 by engine intake air through the connection piece 11. The sucked-in air, on its way through the adsorption filter, flows first through the smaller chamber 3 and then through the larger chamber 4.

Leak-tightness Safety Check

For leak-tightness safety checks to be conducted regularly according to prerequisites known per se, the tank venting system as a whole can be put under pressure by means of the compressed-air source 15. The region to be put under pressure is located between the connection piece 11 and the junction line 17, the said connection piece and junction line being capable of being closed via valves, not illustrated, in order to conduct the test, and comprises the fuel tank, not illustrated, which is connected to the connection piece 9. The compressed air is generated directly within the housing of the compressed-air source 15 designed as a compressed-air pump and is introduced into the system via the line 17. The compressed-air source 15 sucks in the air to be compressed out of the air-filter housing 13 via the junction line 16. The precise nature of a leak-tightness safety test of the tank venting system is known per se and therefore need not be explained in any more detail here.

Active Compressed-air Source While the Engine is in Operation

While the engine is in operation, the compressed-air source 15 designed as an air pump can convey backwash air continuously through the filter 1 into the connection piece 11 of the intake-air line of the engine.

A one-way valve 21, having a stop effect in the direction of the fuel tank, may be arranged in the connection piece 9 leading to the fuel tank which is not illustrated.

The air volume flow conveyed through the filter 1 by the air pump 15 while the engine is in operation is controlled or regulated as a function of relevant engine operating data, the exhaust-gas composition and/or the fuel loading state of the adsorption material of the filter 1.

The integration according to the invention of all the assemblies of a tank venting system into the housing of the adsorption filter of this system results in a modular part which can be produced economically and merely has to be added to the internal combustion engine or the tank via the connection pieces 9 and 11. An independently working compressed-air source integrated into the adsorption filter housing contributes substantially to affording this advantage. As regards attaching this compressed-air source to the adsorption filter housing, it is also important, in this case, that this should take place via vibration-uncoupling elements, and these can be integrated into the connection pieces in a simple way.

We claim:

1. Adsorption filter for a fuel tank venting system of an internal combustion engine, with connections to the atmosphere, to the fuel tank, to the intake-air line of the internal combustion engine, of which those to the atmosphere and to the intake line can be closed in each case by means of a valve, and to a compressed-air source, by means of which, with supply and discharge valves being closed, the venting system can be put under pressure for leak-tightness tests to be carried out regularly, wherein, the adsorption medium is stored in two adsorption chambers of different volume of the filter which are separated from one another and are series connected in terms of flow, the larger (4) of the two adsorption chambers (3, 4) is provided with the connections (9, 11) to the fuel tank, on the one hand, and to the intake-air line, on the other hand, the orifice of the connection piece (11) of the intake-air line opening onto that end of the larger chamber (4) which is remote from the smaller chamber (3) in terms of flow, the compressed-air source (15) is accommodated in a housing which is attached to the housing (1) of the adsorption filter and which is connected, via a first line (17), to that end of the smaller chamber (3) remote from the larger chamber (4) in terms of flow and, via a second line (16), by way of an air-filter housing (13) provided on the housing (1) of the adsorption filter, to the atmosphere, the housing of the compressed-air source (15) is located in the flow path between the atmosphere and that end of the small chamber (3) which is remote from the larger chamber (4) in terms of flow.

2. Adsorption filter as claimed in claim 1, wherein the flow ducts (16, 8; 17, 19) between the housing of the compressed-air source (15) and the atmosphere, on the one hand, and the small chamber (3), on the other hand, run within the housing (1) of the adsorption filter.

3. Adsorption filter as claimed in claim 1, wherein the housing of the compressed-air source 15, is connected to the housing (1) of the adsorption filter via junction lines (16, 17) in a vibration-uncoupled manner.

4. Device as claimed in claim 1, wherein a one-way valve (21) having a stop effect in the direction of the fuel tank is arranged in the connecting line between the adsorption filter (1) and the fuel tank.

5. Method for operating a fuel tank venting system of an internal combustion engine having an adsorption filter as claimed in one of the preceding claims, wherein, while the engine is in operation, the compressed-air source (15) conveys air at least partially and temporarily into the intake-air line of the internal combustion engine.

6. Method as claimed in claim 5, wherein the air volume flow conveyed through the adsorption filter (1) for regeneration is controlled or regulated as a function of relevant engine operating data, the exhaust-gas composition and/or the loading state of the adsorption material of the filter.

* * * * *